US006572399B2

(12) United States Patent
Shimirak

(10) Patent No.: US 6,572,399 B2
(45) Date of Patent: Jun. 3, 2003

(54) ELECTRICAL CONNECTOR

(75) Inventor: Gerald-Leo Shimirak, Holly Springs, NC (US)

(73) Assignee: Channell Limited, Kent (GB)

( * ) Notice: Subject to any disclaimer, the term of this patent is extended or adjusted under 35 U.S.C. 154(b) by 0 days.

(21) Appl. No.: 09/971,987

(22) Filed: Oct. 4, 2001

(65) Prior Publication Data

US 2002/0042221 A1 Apr. 11, 2002

(30) Foreign Application Priority Data

Oct. 11, 2000 (GB) ..... 0024887

(51) Int. Cl.[7] ..... H01R 13/58
(52) U.S. Cl. ..... 439/460; 439/399
(58) Field of Search ..... 439/460, 399, 439/400, 401, 407, 392

(56) References Cited

U.S. PATENT DOCUMENTS 5,030,136 A * 7/1991 Reinhardt et al. ..... 439/460
6,193,543 B1 * 2/2001 Howard et al. ..... 439/459

* cited by examiner

*Primary Examiner*—Renee Luebke
*Assistant Examiner*—Ann McCamey
(74) *Attorney, Agent, or Firm*—Lahive & Cockfield, LLP

(57) ABSTRACT

A connector for an electrical cable, comprising a body in which is formed a passageway having a longitudinal axis, a contact element which projects into the passageway in order to make contact with the electrical cable when in the passageway, and a retaining element for hindering longitudinal withdrawal of the cable from the passageway, the retaining element comprising a pair of resiliently deformable lips extending into the passageway from a face thereof in a first direction transverse to the longitudinal direction, each of the lips being separated from a face of the passageway in a second direction transverse to both the first direction and the longitudinal axis, thereby to allow flexing of the lips in the second direction. The lips are advantageously shorter than the depth in the first direction of the passageway, typically 40 to 80% of the passageway depth. Further lips can be provided on a lid which covers the passageway, the further lips extending in a direction opposed to the first lips. The lips are preferably chamfered along their adjacent edges, ideally to a point. It is further preferred that the angle of chamfer increases along the length of the lip. Thus, it will be at a minimum at the base of the lips where they meet the passageway and will increase along the extent of the lips. The lips can either meet at their adjacent edges, or a gap can be provided therebetween, depending on the intended wire gauge or range of wire gauges.

6 Claims, 2 Drawing Sheets

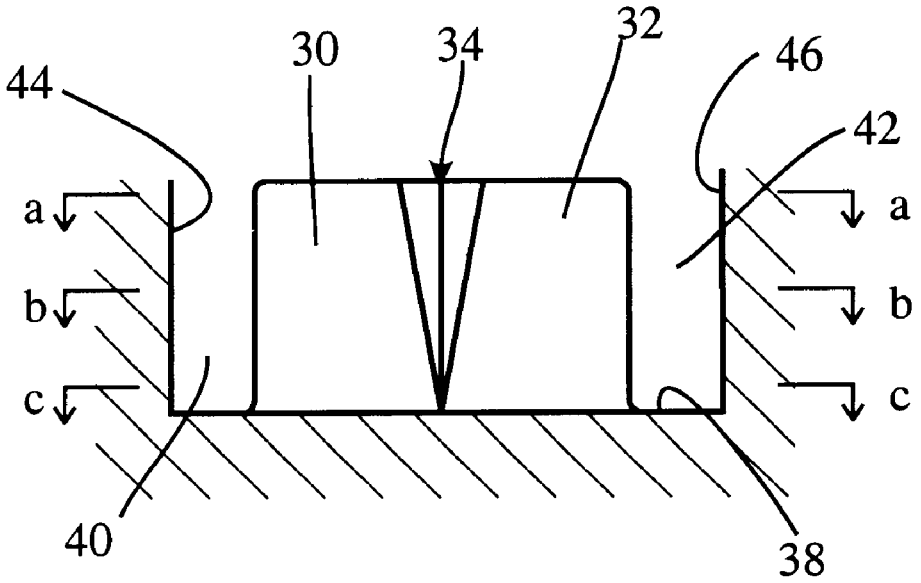
Fig 2
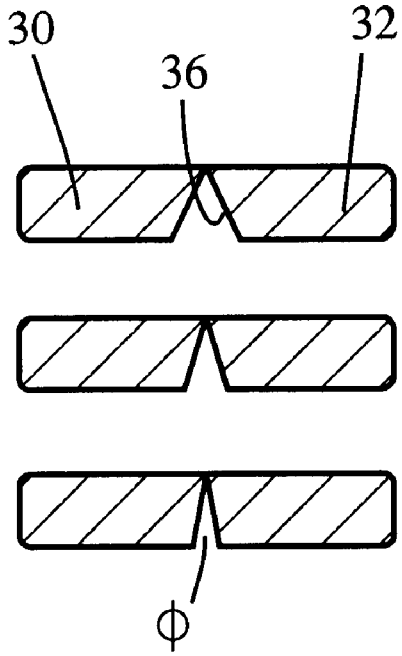
Fig 3a
Fig 3b
Fig 3c

ELECTRICAL CONNECTOR

FIELD OF THE INVENTION

The present invention relates to an electrical connector, particularly (but not exclusively) to an electrical connector for use in telecommunications systems.

BACKGROUND ART

In the field of electrical connectors, it is usual to provide a form of strain relief for the cable to prevent or hinder accidental removal of the cable and to restrain the cable relative to contact members within the connector to maintain an adequate electrical contact. A known strain relief is shown in U.S. Pat. No. 5,030,136 in which flexible retaining tongues are formed within a cable passageway, the tongues serving to retain the cable therebetween, and being resiliently deformed upon insertion of the cable. The tongues extend inwardly towards each other from walls of the passageway and define a slot between them which is narrowest at its entrance and widens towards its root. They flex along the axis of the passageway when a cable is inserted.

This arrangement provides an adequate grip but is complex and difficult to manufacture. Accordingly, the cost of manufacture is increased and the likelihood of defective grips being produced is increased. As a result, the present invention seeks to provide a cable grip for a connector which is easier to manufacture and therefore incurs lower cost.

SUMMARY OF THE INVENTION

The present invention therefore provides a connector for an electrical cable, comprising a body in which is formed a passageway having a longitudinal axis, a contact element which projects into the passageway in order to make contact with the electrical cable when in the passageway, and a retaining element for hindering longitudinal withdrawal of the cable from the passageway, the retaining element comprising a pair of resiliently deformable lips extending into the passageway from a face thereof in a first direction transverse to the longitudinal direction, each of the lips being separated from a face of the passageway in a second direction transverse to both the first direction and the longitudinal axis, thereby to allow flexing of the lips in the second direction.

The lips are advantageously shorter than the depth in the first direction of the passageway. A particularly advantageous length is in the range 40 to 80% of the passageway depth. This eases the flexing of the lips to accommodate a cable. It also permits further lips to be provided on a lid which covers the passageway, the further lips extending in a direction opposed to the first lips. This means that a superior combination of flexing ability on the part of the lips can be combined with a grip for the cable around substantially its entire circumference.

The lips, when undeformed, meet or face each other at their adjacent edges. It is preferred that they are chamfered along those edges, ideally to a point. This allows the edge to grip the cable along a line, potentially deforming the insulation of the cable and providing a more secure grip. It is further preferred that the angle of chamfer increases along the length of the lip. Thus, it will be at a minimum at the base of the lips where they meet the passageway and will increase along the extent of the lips. This provides a physically robust lip which will therefore be reliable in service.

The lips can either meet at their adjacent edges, or a gap can be provided therebetween, depending on the intended wire gauge or range of wire gauges.

BRIEF DESCRIPTION OF THE DRAWINGS

An embodiment of the present invention will now be described by way of example, with reference to the accompanying drawings, in which;

FIG. 2 is a side view of a single pair of retaining lips; and

FIGS. 3*a* to 3*c* are horizontal sections through the lips of FIG. 2.

DETAILED DESCRIPTION OF THE EMBODIMENT

Figure 1:
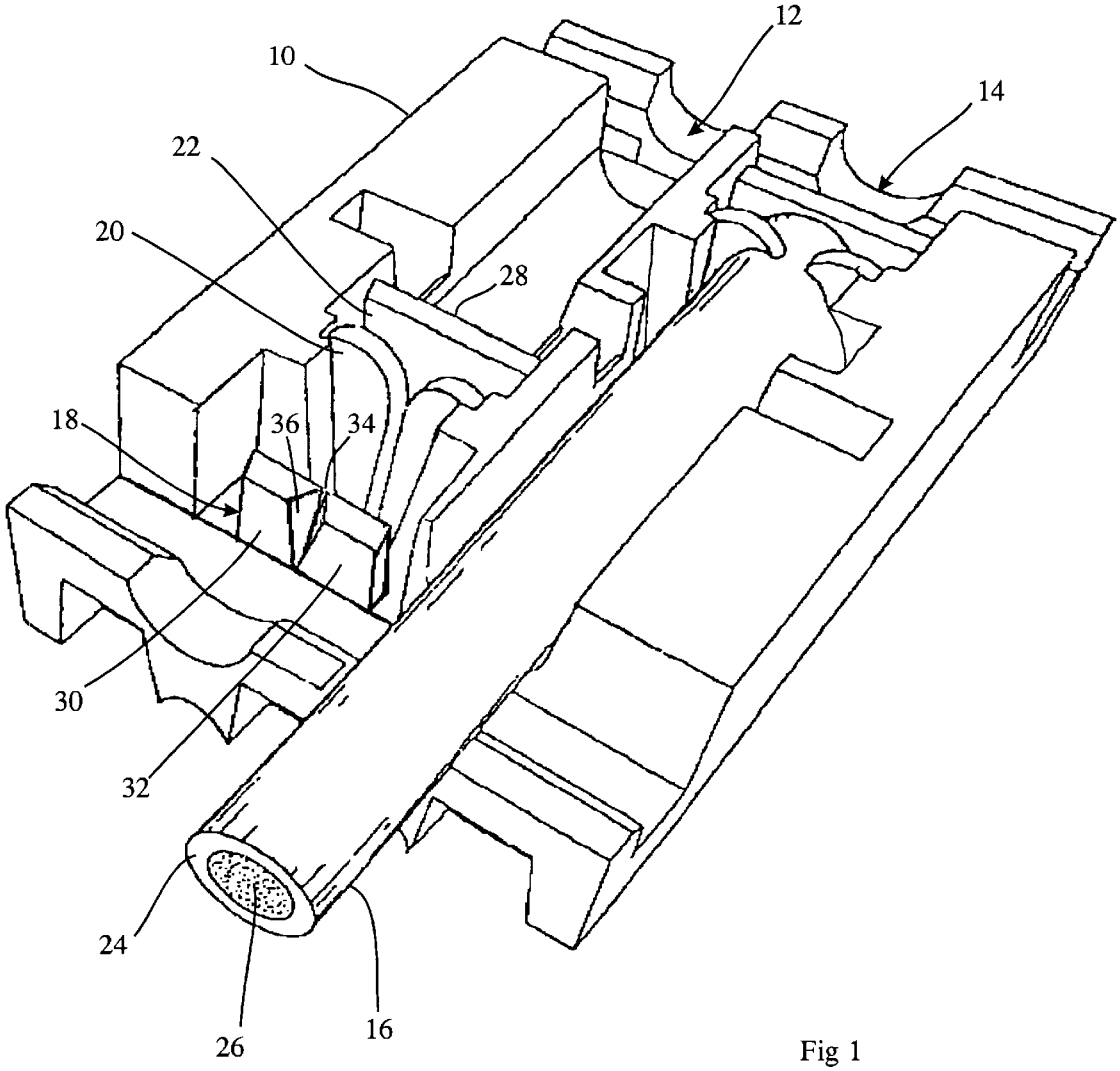
FIG. 1 is a perspective view of a connector according to the present invention.

Referring to FIG. 1, a connector body 10 is provided in which is formed a passageway 12 sized to accept a cable. The passageway 12 is defined on three sides and open along its top edge to allow the cable to be inserted. An adjacent passageway 14 is provided, in which is shown an insulated cable 16. Passageway 12 is empty in order to show the device structure. It will be appreciated that more than two cables could be accommodated by appropriate duplication of the structure, or that only a single passageway could be employed.

Within the passageway, there are formed, in order, a retaining structure 18, an insulation displacing contact (IDC) 20, and a cutting blade 22. Thus, when a cable 16 is placed over the passageway and pressed home, the IDC 20 pierces the insulation 24 and makes electrical contact with the conductor 26 of the cable. The cutting blade 22 has a sharp edge 28 facing upwards towards the initially overlying cable 16, and when the cable 16 is pressed home onto the cutting blade 22 it is severed. This removes the need for an engineer to trim the cable 16 accurately. The IDC 20 and cutting blade 22 are of a known design.

The retaining structure 18 comprises two lips 30, 32. These extend upwardly from the base of the passageway and (in this case) meet at 34 along their side edges. A slit is thus formed into which the cable is forced when it is pressed home into the passageway. The adjacent edges of the lips 30, 32 are chamfered at 36 to sharpen the slit and provide a more positive grip. The angle of the chamfer increases toward the tips of the lips 30, 32 so as to provide a firm structure at the base of the lips which is therefore robust in use, whilst providing a relatively open slit at the tips into which the cable can more easily be inserted.

FIGS. 2 and 3*a* to 3*c* show the lips 30, 32 in more detail. Each is generally rectangular and extends upwardly from the lower face 38 of the passageway. A gap 40, 42 is provided on either side of the lips 30, 32 between the lip and the respective side face 44, 46 of the passageway. This allows the lips 30, 32 to flex outwardly to accommodate a cable and develop a restoring force which will press the lips into the cable insulation and provide a secure grip.

FIGS. 3*a* to 3*c* illustrate that the angle $\phi$ of the chamfer varies along the length of the lip. At the root of the lip (FIG. 3*c*) close to the lower face 38 of the passageway, the chamfer is at a minimum to provide a firm anchor for the lip and give adequate mechanical strength. At the tip of the lip (FIG. 3*a*), the chamfer is at a maximum to ease the entry of the cable.

It can be seen from FIG. 1 that the retaining structure 18, IDC 20 and cutting blade 22 are displaced in adjacent passageways 12, 14. This is because IDCs open slightly as the cable 16 is inserted, and displacement of the structures between adjacent passageways prevents any distortion to the body 10 caused by one IDC from affecting the operation of an IDC in the adjacent passageway.

It will be appreciated that many variations may be made to the above-described embodiment without departing from the present invention. For example, as mentioned, more or fewer cables could be catered for. Other gauge ranges could be catered for by appropriate adjustment of the size and spacing of the retaining structure 18 and variance of the gap at 34. The retaining structure 18 could be employed in other designs of connector.

What is claimed is:

1. A connector for an electrical cable, comprising a body in which is formed a passageway having a longitudinal axis, a contact element which projects into the passageway in order to make contact with the electrical cable when in the passageway, and a retaining element for hindering longitudinal withdrawal of the cable from the passageway, the retaining element comprising a pair of resiliently deformable lips extending into the passageway from a face thereof in a first direction transverse to the longitudinal direction, each of the lips being separated from a face of the passageway in a second direction transverse to both the first direction and the longitudinal axis, thereby to allow flexing of the lips in the second direction.

2. A connector according to claim 1 in which the lips are shorter than the depth in the first direction of the passageway.

3. A connector according to claim 2 in which the length of the lips is in the range 40 to 80% of the passageway depth.

4. A connector according to claim 1 in which the lips are chamfered along their adjacent edges.

5. A connector according to claim 4 in which the angle of chamfer increases along the length of the lip.

6. A strain relief for an electrical cable, comprising a passageway extending in a longitudinal direction, into which extends a pair of resiliently deformable lips from a face of the passageway in a first direction transverse to the longitudinal direction, each of the lips being separated from a face of the passageway in a second direction transverse to both the first direction and the longitudinal axis, thereby to allow flexing of the lips in the second direction.

* * * * *